United States Patent [19]

Cholet et al.

[11] 4,378,051

[45] Mar. 29, 1983

[54] DRIVING DEVICE FOR DISPLACING AN ELEMENT IN A CONDUIT FILLED WITH LIQUID

[75] Inventors: Henri Cholet, Le Pecq; Robert Desbrandes, Sevres; Guy Norel, La Celle Saint Cloud, all of France

[73] Assignee: Institut Francais du Petrole, Rueil-Malmaison, France

[21] Appl. No.: 218,245

[22] Filed: Dec. 19, 1980

[30] Foreign Application Priority Data

Dec. 20, 1979 [FR] France ..... 79 31561

[51] Int. Cl.[3] ..... E21B 23/08; E21B 33/127; E21B 47/06

[52] U.S. Cl. ..... 166/383; 166/65 R; 166/113; 166/187; 166/387

[58] Field of Search ..... 166/187, 113, 53, 255, 166/254, 106, 105.4; 254/134.4, 134.5; 175/383, 357

[56] References Cited

U.S. PATENT DOCUMENTS

| | | | |
|---|---|---|---|
| 2,828,823 | 7/1955 | Mounce | 166/187 |
| 2,859,828 | 11/1958 | Williams | 166/106 |
| 3,066,739 | 12/1962 | Saurenman | 166/187 |
| 3,083,774 | 4/1963 | Peters et al. | 166/187 |
| 3,158,200 | 11/1964 | Malone | 166/106 |
| 3,209,835 | 10/1965 | Bourne, Jr. et al. | 166/187 |
| 3,321,184 | 5/1967 | Goss | 254/134.4 |
| 3,401,749 | 9/1968 | Daniel | 166/254 |
| 3,692,108 | 9/1972 | Soulie | 166/153 |
| 4,113,236 | 9/1978 | Neinast | 254/134.5 |

*Primary Examiner*—Stephen J. Novosad
*Assistant Examiner*—Joseph Falk
*Attorney, Agent, or Firm*—Millen & White

[57] ABSTRACT

The device, which is connected to an element to be displaced, comprises a tubular body surrounded by sleeves which are inflated to a diameter slightly smaller than the diameter of the conduit. A motor-pump assembly located in the tubular body provides for the circulation of the fluid through the body so as to cause propulsion of the device within the conduit. Sensors may control automatic operation of the device and inflation of the sleeves to the selected diameter.

18 Claims, 7 Drawing Figures

DRIVING DEVICE FOR DISPLACING AN ELEMENT IN A CONDUIT FILLED WITH LIQUID

BACKGROUND OF THE INVENTION

The present invention relates to a driving device for displacing an element in a conduit filled with liquid.

The term element is used here to designate tools such as scraping tools, mini-corers, etc., measuring instruments, such as a measuring sonde, or any other element which, at a given time, must be displaced within a conduit.

The term conduit is used here to designate either conduits formed by tubes or wells drilled in the ground by any suitable method.

Devices for displacing tools within a conduit are already known and described, for example, in U.S. Pat. No. 3,052,302.

These prior art devices generally comprise a body having an extension to which above-discussed tool is connected.

One, or several inflatable sleeves surround the body and seal an annular space between the body of the device and the wall of the conduit wherein the device is employed.

The displacement of such a device is achieved by pumping the fluid which fills the conduit and this requires access to both ends of the conduit.

Such prior art devices are therefore not suitable for displacing an element such as a measuring sonde in a wellbore during drilling operations.

The use of inflatable membranes in wellbores is also known from U.S. Pat. No. 3,960,211 which describes a device adapted to take an impression of the wall of a casing, or from U.S. Pat. No. 3,209,835 which describes an inflatable packer adapted to isolate a portion of a wellbore. Inflatable sleeves are also described in U.S. Pat. Nos. 2,942,667 and 2,946,565 for sealing the annular space between a borehole wall and a drill string, so as to isolate the zone of the borehole which is just above the drill bit, and to adjust the pressure of the drilling fluid to a selected value in this portion of the borehole.

These sleeves are slidable along the drill string and move stepwise under the influence of gravity while enabling the drilling operation to progress after the sleeves have been inflated to make them integral, or place them in contact, with the borehole wall.

These prior devices are therefore not adapted to displace an element in a conduit of high inclination relative to a vertical line, in particular in a subhorizontal conduit, because the influence of gravity then can no longer provide for a stepwise displacement of the slidable sleeve.

In practice an element such as a measuring sonde can be displaced by the influence of gravity without great difficulty as long as the inclination of the drilled well relative to a vertical line is not substantially greater than 45°. Beyond this limit the displacement of the sonde is possible only if the profile of the drilled hole and the variations of its diameter are known, and if sondes of a reduced size are used. In highly inclined boreholes the displacement of the sonde can only be obtained by applying a thrust thereon by means of a relatively stiff rod at one end of which the sonde is connected.

However, displacing a sonde in a wellbore remains an operation whose duration and difficulty increases with the angle of inclination of the wellbore relative to the vertical line.

In order to obviate these drawbacks, it has been proposed, in U.S. Pat. No. 4,113,236, to provide a jet propulsion device to which is connected the element to be displaced. A disadvantage attendant to this device is that considerable power has to be transmitted to the device to produce sufficiently efficient fluid jets, capable of displacing an element in a wellbore of high inclination relative to the vertical axis. Moreover, the operation of such a device is not reversible and the displacement can only be effected in one direction. Furthermore, the fluid jets have deleterious effects on the borehole wall when the latter is not protected by a casing.

The main object of the invention is therefore, to provide a device which does not suffer from the above-discussed disadvantages, and permits displacement of an element within a conduit of high inclination relative to the vertical axis, or a conduit having horizontal sections, or even portions along which the device is displaced against the influence of gravity.

SUMMARY OF THE INVENTION

The device according to the invention for displacing an element connected to this device within a conduit filled with a fluid, comprises a tubular body having openings at both ends, i.e., a first one and a second one, and each having a cross-section smaller than that of the conduit a motor-pump assembly having an inlet orifice and an outlet orifice which communicate respectively with the ends of the tubular body, and this motor-pump assembly providing for fluid circulation through said tubular body, at least one resilient sleeve surrounding one portion of the tubular body and defining therewith a sealed annular space, and means for inflating said sleeve.

This device is characterized in that at least one end of the sleeve is secured to the tubular body and the inflating means are adapted to inflate said sleeve until its diameter becomes slightly smaller than the diameter of the conduit.

According to a first embodiment of the invention, the motor-pump assembly has a reversible operation so as to permit displacement of the device in both directions.

According to another embodiment, the sleeve or sleeves are automatically inflated to the desired diameter, so as to follow the variations in the cross-section of the conduit.

BRIEF DESCRIPTION OF THE DRAWINGS

The invention will be more easily understood and all its advantages made clearly apparent from the following description illustrated by the accompanying drawings wherein.

DETAILED DISCUSSION OF THE INVENTION

For a better understanding of the following description, reference will be made more particularly, but not limitatively, to the case of a device for displacing a measuring sonde within a diverted borehole, i.e. within a borehole of which at least a portion has a substantial angle of inclination relative to the vertical axis.

Figure 1A:
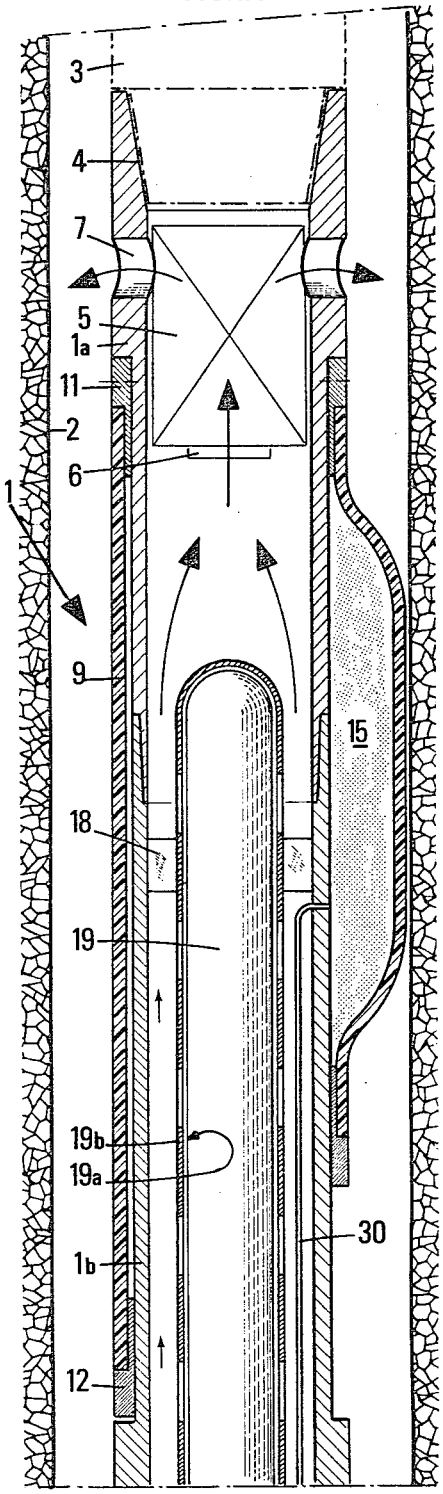
FIGS. 1A and 1B diagrammatically illustrate in axial cross-section the upper and lower parts of a device according to the invention.
Figure 1B:
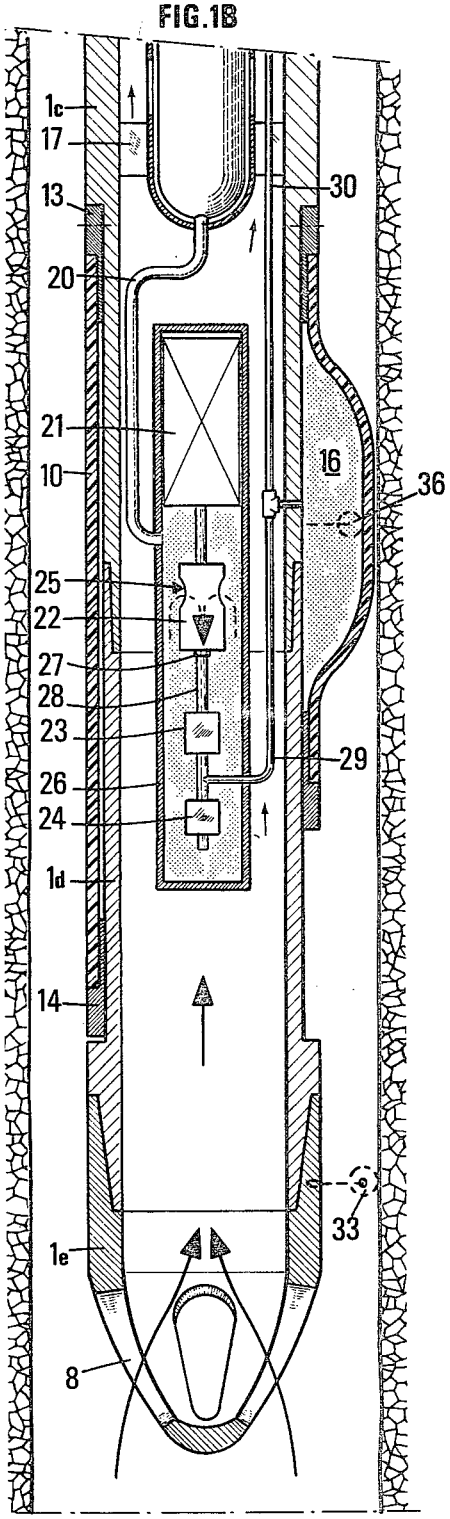

FIGS. 1A and 1B show in cross-section the device according to the invention designated as a whole by reference number 1.

This device is, for example, used for displacing in a wellbore 2 a measuring sonde 3 diagrammatically shown in hatched line in FIG. 1A. This sonde may be of any known type, the sensitive element (which may be electrical, magnetic, acoustical, etc.) of this sonde being carried by the sonde body or by an element adapted to contact the borehole wall. The sonde 3 is connected to the surface by a handling or supporting cable (not shown) wherein are incorporated power and data transmission lines. The sonde, forming no part of the invention, will not be described in detail.

In the illustrated embodiment the device 1 is secured to the free end of the sonde 3 by means of threads 4.

The body of the device, having a outer diameter smaller than the diameter of the borehole 2, is comprised of, for example, but not limitatively one or more tubular elements 1*a*, 1*b*, 1*c* . . . connected end to end.

A motor-pump assembly, diagrammatically shown at 5, is located within the tubular body. The inlet orifice 6 of the pump communicates with the interior of the tubular body, whereas the outlet orifice communicates with the annular space defined between the wall of the borehole 2 and the device 1, through apertures or ports 7 provided at the upper part of the tubular body.

At its lower end the tubular body communicates with the borehole 2 through apertures 8.

The body of the device 1 is surrounded over a part of its length by a resilient membrane or sleeve located at an intermediate level between the first open end 8 and second open end 7.

Preferably, as shown in FIGS. 1A and 1B, there is used two membranes 9 and 10 spaced from each other, i.e. located at different levels.

At one of its ends the upper membrane 9 is secured to a ring 11 by any known process, such as by vulcanizing. The ring 11 is integral with the body of the device 1.

At its other end, the sleeve 9 is integral with a ring 12 which is axially slidable along the body of the device 1.

Similarly the sleeve 10 is secured at one end to a ring 13 integral with the body of the device 1 and is secured at its other end to a ring 14 slidably mounted on the body of the device 1.

Sealing between the rings 12 and 14 and the body of the device 1 is ensured by gaskets (not shown).

The sleeves 9 and 10 define with the tubular body sealed annular spaces, respectively designated by references 15 and 16.

In the absence of outer forces applied to the sleeves 9 and 10, the latter have a generally cylindrical shape whose outer diameter is substantially smaller than the diameter of the drilled borehole 2. In the illustrated embodiment these sleeves have in their rest position an outer diameter substantially equal to that of the tubular body, as shown on the left side of the drawings.

The device also comprises inflating means for increasing the outer diameter of the sleeves by introducing a liquid under pressure within the annular spaces 15 and 16.

These inflating means comprise a tank 19 containing a liquid such as oil. This tank which is held by arms 17, 18 within the body of the device, comprises a flexible membrane 19*a*, protected by a casing 19*b*. The oil contained in the tank is thus under the hydrostatic pressure of the fluid filling the borehole 2.

This tank 19 feeds a sealed housing 26 through a pipe 20. In the housing 26 is located a second motor-pump assembly comprising a motor 21, driving a pump 22, preferably at a constant flow rate, and two valves 23 and 24 having two ways and two positions. The inlet orifice 25 of the pump communicates with the inner part of the housing 26. The discharge orifice 27 of the pump 22 communicates through a pipe 28 with one of the orifices of the valve 23 whose second orifice communicates on the one hand, with a first orifice of the valve 24 and on the other hand, with the annular spaces 15 and 16 through pipes 29 and 30 which open respectively in these annular spaces 15 and 16. The second orifice of the valve 24 communicates with the interior of the housing 26.

Power cables (not shown) supply power to the motor-pump assembly 5 and to the motor 21 and permit control of the valves 23 and 24 which are, for example, electrically actuated valves. These cables may be embedded in the handling cable of the sonde 3.

The operation of the device is indicated below. The device 1 secured to the end of the sonde 3 is introduced into the borehole 2, the sleeves 9 and 10 being not inflated as illustrated on the left side of FIGS. 1A and 1B.

When the so-formed assembly can no longer progress under the action of gravity, i.e. when the inclination of the borehole is too high, the following operating steps are carried out:

a/ The electrically controlled valve 24 is placed into its closed position interrupting the communication between its two orifices, b/ the electrically controlled valve 23 is actuated so as to bring its two orifices in communication with each other, c/ the motor-pump assembly 5 is actuated and causes the fluid filling the borehole to flow in the direction indicated by the arrows in solid lines; this fluid enters the tubular body of the device through the first open end 8, then flows through the pump 5 which injects it through the second open end 7 into the annular space defined between the wall of the borehole 2 and the device 1, i.e. downstream of the sleeves 9 and 10 when considering the direction of flow of this fluid within the body of the device 1 and, simultaneously, d/ power is supplied to the motor 21 which actuates the pump 22; the oil sucked by the pump 22 is discharged through the valves 23 and the pipes 29 and 30 into the annular spaces 15 and 16 thereby inflating the sleeves 9 and 10 (right side of FIGS. 1A and 1B); this inflation is continued until the sleeves reach an outer diameter slightly smaller than the diameter of the borehole 2; The sleeves then behave as pistons on which is applied the pressure of the fluid injected by the motor-pump assembly 5 and the device thus is forced to move and progresses within the borehole, and e/ when the sleeves have been inflated to the desired diameter, as indicated below, the electrically controlled valve 23 is placed by remote control into its position where the communication between its two orifices is interrupted and the motor 21 is no longer energized so that operation of the pump 22 is discontinued.

It is clear from the foregoing discussion that the oil required for inflating the sleeves is supplied from the tank 19.

Optimum inflation or expansion of the membranes 9 and 10 depends on the diameter of the conduit wherein the device is displaced. This optimum inflation can be easily determined in the case of a conduit of constant diameter such as a casing. In the case of a borehole drilled through ground layers, the operator can easily determine the optimum inflation which corresponds to the maximum running speed of the power supply and data transmission cable from which the assembly of the device 1 and of the sonde 3 is suspended, this running speed being measured at the surface.

In the case of a logging sonde 3, measurements are usually performed as the sonde is progressively raised back to the surface by exerting a pull on the handling cable. To facilitate this operation the sleeves must be deflated. This is obtained by actuating the valve 24 so as to place it into the position where its two orifices communicate with each other. Oil under pressure contained in the annular spaces 15 and 16 then flows through the housing 20 into the tank 19 until the sleeves 9 and 10 are deflated and return to their initial position.

However, it is also possible to achieve displacement of the device in the other direction by using a reversible motor-pump assembly 5, i.e. capable of sucking the fluid filling the well through the second open end 7 and to discharge this fluid through the orifice 6.

The sleeves are made of a resilient material such as an elastomer and may be reinforced over at least a part of their length so that this part keeps a generally cylindrical shape when the sleeves are inflated.

Figure 2:
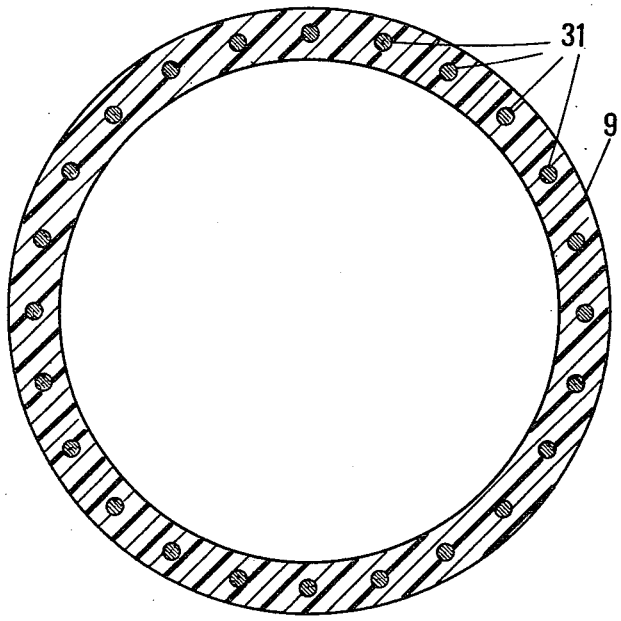
FIGS. 2 and 3 respectively illustrate non-limitative embodiments of the resilient sleeves employed in the device of the invention, FIG. 4 diagrammatically shows a first embodiment of means for automatically inflating the sleeves.
Figure 3:
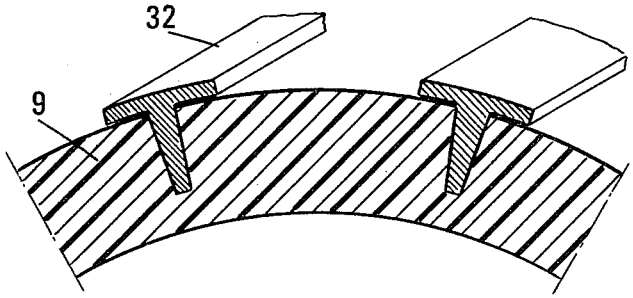

The reinforcements may comprise at least one layer of metal wires either axially disposed or helically wound and embedded in the wall of the sleeves 9 or 10, as shown in FIG. 2. However, the reinforcing elements may have any suitable shape, being for example, made up of rods 32 having a T-shaped cross-section of which only the part embedded in the wall of the sleeve is adherent to the resilient material which constitutes the sleeve, as shown in FIG. 3.

Other changes or modifications may be made without departing from the scope of the present invention.

For example, it is possible to equip the device 1 with means for sensing the diameter of the borehole such as the section sensor 33 diagrammatically shown in broken line in FIG. 1 B. This section sensor may comprise an element which is displaceable at least in a radial direction, so as to come into contact with the borehole wall and thus indicate the local diameter of the borehole. The section detector 33, which may be of any known type will not be described in detail.

The user may then rely to the data supplied by this section sensor to expand the sleeves 9 and 10 to the desired size.

Sensors, such as strain gauges, pressure sensors, devices for measuring the displacement of the ring 14, etc. may be used after calibration, to indicate the diameter of the inflated sleeves.

In the embodiment illustrated by the drawings the device according to the invention is connected to a logging sonde but it is possible to use the device 1 as the sonde body.

Moreover the use of this device for displacing a logging sonde has only been indicated by way of non limitative example, this device being suitable to displace any element which must be moved within a conduit. In the embodiment illustrated in FIGS. 1 A and 1 B the element to be displaced is positioned between the handling cable and the device according to the invention. However it would also be possible to place this device between the handling cable and the element to be displaced.

In the case where the system comprised of the motor 21 and the pump 22 is not reversible, it is possible to omit the electrically controlled valve 23. This valve may also be replaced by a non-return valve.

It is obviously possible to connect the two ends of the sleeves 9 and 10 to the body of the device, the deformation of the sleeves being then only caused by their resiliency.

Figure 4:
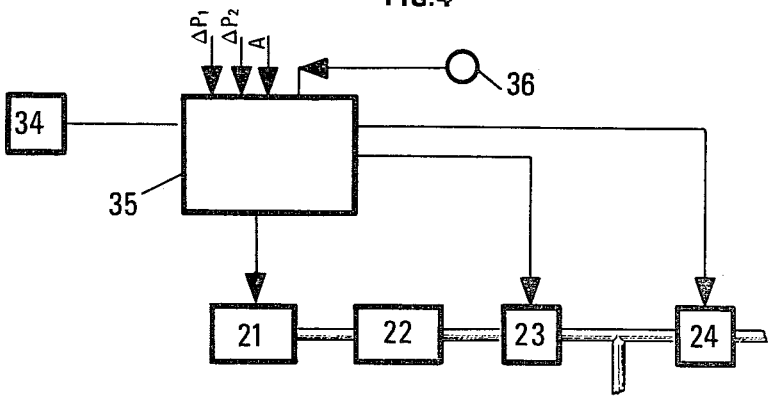

The sleeves may be automatically inflated by using a differential pressure sensor 34 (FIG. 4). Such a sensor is well known in the art and does not require any detailed description.

The differential pressure sensor 34 may be for example, of the type commercially available under the *TRADE MARK CDPD of SOCIETE SAINT CYR-ELECTRO-INDUSTRIE* (FRANCE).

This sensor is used to measure the pressure difference between the inlet and outlet of the motor-pump assembly 5.

The sensor 34 delivers a signal representing the measured pressure difference. This signal is transmitted to an electronic assembly 35 controlling inflation and deflation of the sleeves 9 and 10, i.e. an assembly capable of monitoring the motor 21 of the pump 22 and the valves 23 and 24.

The control assembly 35 comprises means for comparing the signal delivered by the sensor 34 with two predetermined values $\Delta P_1$ and $\Delta P_2$ such that $\Delta P_1 < \Delta P_2$ When the measuring signal delivered by the sensor 34 is lower than the threshold value $\Delta P_1$, the control assembly produces output signals adapted to close the valve 24, to open the valve 23 and to actuate the motor 21.

This causes inflation of the sleeves 9 and 10.

When the measuring signal delivered by the sensor 34 is comprised between the values $\Delta P_1$ and $\Delta P_2$, the control assembly generates output signals which maintain the valve 24 in its closed position, close valve 23 and stop the motor 21.

When the measuring signal has a value higher than the threshold-value $\Delta P_2$, the control assembly delivers, on its output terminals, signals which close the valve 24, maintain the valve 23 in its closed position and the motor 21 in its rest off position.

This causes deflation of the sleeves 9 and 10.

Thus, if during the displacement of the device, all the sleeves carried by the body 1 are placed in a portion of the wellbore of a diameter substantially greater than the diameter of the sleeves, the value of the differential pressure decreases below the value $\Delta P_1$. Inflation of the sleeves occurs as described above.

On the contrary, if during the displacement of the device one of the sleeves reaches a zone of the wellbore whose diameter is smaller than the diameter of the sleeve, the pressure difference, measured by the sensor 34, increases beyond the threshold value $\Delta P_2$ and the control assembly 35 causes a deflation of the sleeves, as described above.

The values $\Delta P_1$ and $\Delta P_2$ are experimentally ascertained in relationship with the force which is necessary to displace the device in boreholes of known diameters and inclination.

The control assembly 35 is for example, of the programmed micro processor type and its operation as above described, is initiated upon reception of an initiation signal A produced by the user, for example, when starting the motor-pump assembly 5. It is also possible to provide, for safety reasons, a sensor such as the sensor 36 diagrammatically shown in FIG. 1 B, which delivers a signal representing the diameter of one of the sleeves, this sensor interrupting the inflation of the sleeves when they have reached their maximum diameter $\phi_M$.

Figure 5:
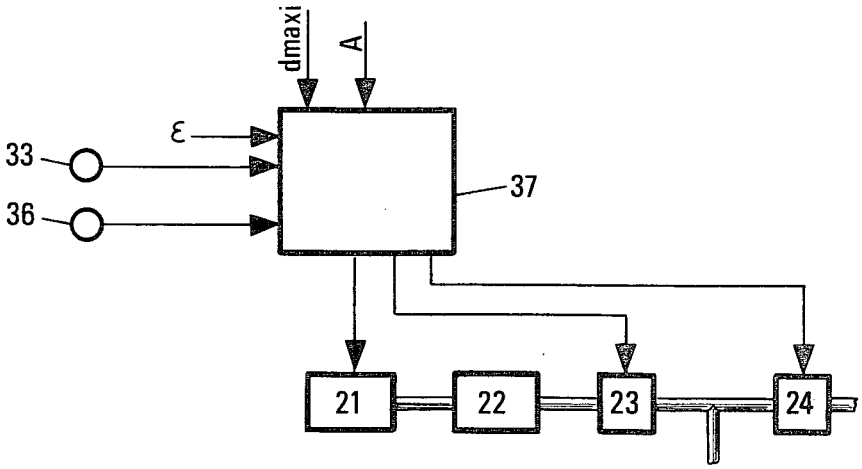
FIG. 5 shows another embodiment of the means for automatically inflating the sleeves.

FIG. 5 shows another embodiment of means for automatically controlling inflation and deflation of the sleeves 9 and 10.

There is used a control assembly 37 for inflating or deflating the sleeves which is, for example, of the micro-processor type being suitably programmed to control the operation of the motor 21 and the valves 23 and 24.

This assembly receives the signals delivered by the section sensor 33, which measures the diameter of the borehole upstream of the sleeve 10 and in the vicinity thereof, and the signals delivered by the sensor 36 which may be also of the section sensor type and measures the inflation diameter of one of the sleeve, both sleeves having identical deformation characteristics.

Operation of the control assembly 37 is initiated at the reception of a signal A delivered at the start of the motor-pump assembly 5.

The section sensor 33 indicates the value of the diameter D of the borehole and the assembly 37 delivers, on its output terminals, signals which close the valve 24, open the valve 23 and starts the operation of motor 21. Inflation of the sleeves is continued until the sensor 36 delivers a signal representing a predetermined value d of the sleeve diameter equal to D-$\epsilon$, $\epsilon$ being a selected value set in the control assembly 37. This value $\epsilon$ is selected by the operator so that the force acting on the device is sufficient to displace it within the borehole.

When the diameter value measured by the sensor 36 is equal to the value $d=D-\epsilon$ the control assembly 37 delivers output signals which maintain the valve 34 in its closed position, close the valve 23 and stop the motor 21.

If during its displacement the device reaches a zone of the borehole of reduced diameter, the section sensor 33 indicates a new value and the control assembly 37 delivers signals which hold the motor 21 in its rest position and the valve 33 in its closed position, while these signals open the valve 24.

This causes deflation of the sleeves which is continued until the indication of the sensor 36 is at least equal to the indication of the section sensor 33 less the value $\epsilon$. At this time the control assembly 37 delivers a signal which closes the valve 24.

If during its displacement the device reaches a zone of the borehole whose diameter is greater than the diameter of the inflated sleeves, the section sensor 33 indicates a new value and the control assembly 37 delivers output signals which hold the valve 24 in a closed position, open the valve 23 and energize the motor 21.

This causes inflation of the sleeves, and their inflation is continued until the indication of the sensor 36 becomes again equal to that of the section sensor 33 less the value $\epsilon$. At this time, the control assembly 37 stops the inflation of the sleeves by stopping the motor 21 and reclosing the valve 23.

Figure 6:
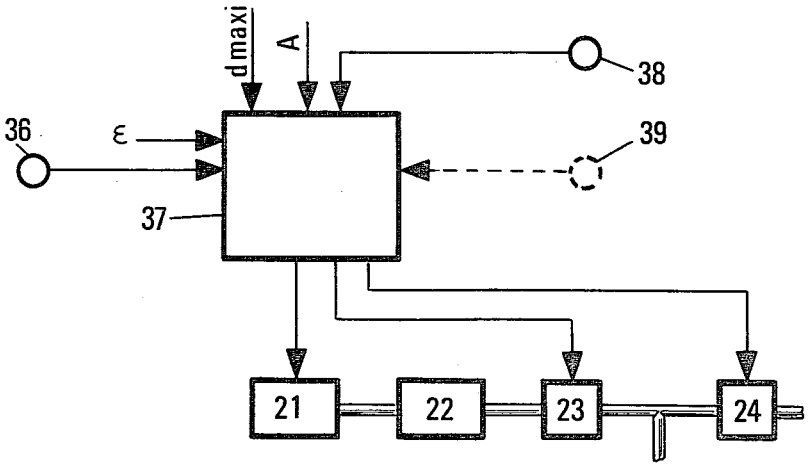
FIG. 6 illustrates alternative modifications of the embodiment shown in FIG. 5.

FIG. 6 illustrates modifications which may be brought to the automatic control device of the sleeves.

Generally, during a drilling operation the diameter of the drilled hole is measured versus its depth. These measurements may then be recorded in a memory of the control assembly 37. The section sensor 33 may then be omitted and a sensor 38 which measures, for example at the surface the length of the cable from which the device is suspended, indicates the depth reached by this device. The corresponding value of the borehole diameter is derived from the memory and inflation or deflation is effected as above indicated.

According to another modification, automatic inflation of the sleeves 9 and 10 is effected only when the device cannot advance under the sole action of gravity. In this embodiment a sensor 39 measures the tension in the cable which connects the device to the surface.

This sensor delivers a signal which permits the operation of the assembly 37 when the tension in the cable is lower than a predetermined value $T_1$, i.e. when the cable is slackened. Moreover, when the tension measured in the cable is greater than another predetermined value $T_2$ corresponding to the force of displacement of the device alone, the assembly 37 causes complete deflation of the sleeves 9 and 10 before interrupting its operation. The device can then be displaced under the influence of gravity.

The value $T_2$ can be determined by measuring the pressure difference $\Delta P$ between the inlet and the outlet of the motor pump assembly 5 as well as the inflation diameter of the sleeves. There is obtained then a value of $$T_2 > \Delta P \times \frac{\pi\,\phi_M^2 - \phi_c^2}{4}$$

where $\phi M$ is the inflation diameter of the sleeves and $\phi_c$ is the diameter of the device body.

As previously indicated, the operation of the assembly 37 is stopped, for safety grounds, when the sensor 36 delivers a signal equal to the maximum inflation diameter d max of the sleeves, this value being set in the control assembly 37.

What is claimed is:

1. A device for displacing an element (3) connectable thereto, through a conduit (2) filled with fluid, the device comprising a tubular body (1) having openings at both ends, and having a cross-sectional area smaller than the cross-sectional area of the conduit (2), circulating means (5) for circulating the fluid through said tubular body, whereby the fluid is caused to flow into the device through a first open end (8) thereof, and is discharged through a second open end (7), said circulating means comprising a first motor-pump assembly (5) having inlet and outlet orifices respectively communicating with said first and second open ends (7,8) of the tubular body, at least one resilient sleeve (9,10) surrounding a portion of the body **(1*a*–1*c*) and defining therewith a sealed annular space (15,16), and inflating means (19,30) for inflating said sleeve (9,10) at least one (11,13) of the ends (11,12,13,14)** of said sleeve being connected to said tubular body (1*a*–1*c*) and said inflating means adapted for inflating said sleeve (9,10) until the outer diameter thereof equals a predetermined value slightly smaller than the diameter of the conduit whereby when said sleeve is inflated, said first motor-pump assembly is actuatable to pump fluid to create a pressure head on one side of said device when its sleeve is inflated to cause the device to slide in the direction the pressure head is exerted.

2. A device according to claim 1, wherein said motor-pump assembly (5) is adapted for reversible operation.

3. A device according to claim 1, wherein said inflating means (19–30) comprises a tank (19) for housing liquid therein, said tank having at least a deformable wall portion (19*a*), a second motor pump assembly (21,22) with the inlet orifice (25) of the pump (21) of said second motor pump assembly in direct communication with said tank (19), and the outlet orifice (27) of said pump (21) in communication with a hydraulic circuit (23,28,29,30) feeding said annular space (15,16), and remotely controlled means for placing in direct communication, in a sequential manner, said annular space (15,16) with said tank (19).

4. A device according to claim 3, wherein said remotely controlled means comprises an electrically controlled valve (24) switchable between two positions, one of which directly connects said annular space (15, 16) to said tank (19).

5. A device according to claim 4, wherein said hydraulic circuit comprises non-return valve means for permitting liquid flow only in the direction for inflating said sleeve.

6. A device according to claim 5, comprising a plurality of sleeves (9, 10) surrounding the device body, said sleeves being connected in parallel to the hydraulic feeding circuit.

7. A device according to claim 4, comprising automatic means (33 to 39) for controlling the operation of said inflating means (19–30).

8. A device according to claim 7, wherein said automatic control means (33 to 39) comprises a differential pressure sensor (34) for measuring the pressure difference between the inlet and the outlet of said motor-pump assembly (5) which circulates the fluid through said tubular body, and a control assembly (35) for actuating said inflating means (19–30) to inflate said sleeves (9,10) when the pressure difference measured by said differential pressure sensor (34) is smaller than a first predetermined value ($\Delta P_1$), and for deflating said sleeves (9,10) when the pressure difference measured by the pressure sensor (34) is higher than a second predetermined value ($\Delta P_2$) which is greater than said first value ($\Delta P_1$), said control assembly (35) adapted for interrupting the operation of said inflating means (19–30) when the pressure difference measured by the pressure sensor (34) falls between said two predetermined values ($\Delta P_1$ and $\Delta P_2$).

9. A device according to claim 7, comprising sleeve diameter sensing means (36) for measuring the diameter of the inflated sleeve (9,10), position sensing means (38) for determining the position of the device in the conduit, and a control assembly (37) for recording the values of the conduit diameter in relation to the length of this conduit, said control assembly adapted for actuating said inflating means until the value measured by said sleeve diameter sensing means (36) equals the recorded value of the conduit diameter at the sensed position, minus a predetermined value ($\epsilon$).

10. A device according to claim 7, comprising conduit diameter measuring means (33) for measuring the diameter of the conduit upstream of said resilient sleeve (9,10) in the direction of progression of said device in the conduit, sleeve diameter sensing means (36) for measuring the diameter of the inflated sleeves (9,10), and a control assembly (37) for actuating said inflating means (19-30) until the value of the measured diameter of the sleeve by said sleeve diameter sensing means equals the value of the measured diameter of the conduit by said conduit diameter measuring means minus a predetermined value ($\epsilon$).

11. A device according to claim 9 or 10, wherein said device is connected to the surface by means of a cable, and further comprising tension sensing means (39) for sensing the tension in the cable, said tension sensing means (39) adapted for permitting operation of said control assembly (37) when the tension in the cable is lower than a first predetermined tension value ($T_1$), and for interrupting the operation of said control assembly (37) when the tension in the cable is higher than a second predetermined value ($T_2$) greater than said first predetermined tension value ($T_1$).

12. A device according to claim 1, comprising measuring means (33) for measuring the diameter of the conduit upstream of said resilient sleeve (9, 10) when considering the direction of progression of the device in the conduit.

13. A method of displacing an element in a conduit filled with fluid by means of a device comprising a tubular body open at both ends and having a cross-sectional area smaller than the cross-sectional area in which the element is to be displaced, circulating means for circulating the fluid in the conduit through the tubular body by causing the fluid to flow into a first open end thereof and discharged out a second open end thereof, said circulating means comprising a motor pump assembly having inlet and outlet orifices respectively communicating with said first and second open ends of the tubular body, at least one resilient sleeve surrounding a portion of the body and defining therewith a sealed annular space, and inflating means for inflating said sleeve, with at least one of the ends of said sleeve being connected to said tubular body, and said inflating means adapted for inflating said sleeve until the outer diameter thereof equals a predetermined value slightly smaller than the diameter of the conduit in which the device is employed, the method comprising:

attaching the device to the element to be displaced;

inserting the device with the element attached thereto into a well bore;

inflating said sleeves to a diameter slightly smaller than the diameter of the well bore; and pumping the fluid in said conduit into the open end of said tubular body located at the forward end of the tubular body in the direction the device is being displaced and out the other end at the rear of the tubular body relative to the direction of displacement whereby the fluid being discharged out the other end exerts a pressure on said sleeve in the direction the device is being displaced with the inflated sleeve behaving as a piston and causing movement of the device in response to said pressure.

14. A method according to claim 13, wherein said attaching step comprises attaching the device to a well bore tool.

15. A method according to claim 14, further comprising reversing the direction of pumping of the fluid to cause displacement of the element in the conduit in a direction opposite to the first direction of displacement.

16. A method according to claim 13, wherein said attaching step comprises attaching the device to a scraping tool.

17. A method according to claim 13, wherein said attaching step comprises attaching the device to a minicorer.

18. A method according to claim 13, wherein said attaching step comprises attaching the device to a measuring sonde.

* * * * *